US006205640B1

(12) United States Patent
Dubugnon

(10) Patent No.: US 6,205,640 B1
(45) **Date of Patent: *Mar. 27, 2001**

(54) METHOD FOR JOINING TOGETHER TWO OR SEVERAL OVERLAYING SHEET FORMED MEMBERS, AND APPARATUS FOR CARRYING OUT SAID METHOD AND A JOINT RESULTING FROM SAID METHOD

(75) Inventor: Olivier Dubugnon, Vullierens (CH)

(73) Assignee: Attexor Equipements S.A., Ecublens (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/736,788

(22) PCT Filed: Mar. 31, 1994

(86) PCT No.: PCT/EP94/01029

§ 371 Date: Nov. 30, 1994

§ 102(e) Date: Nov. 30, 1994

(87) PCT Pub. No.: WO94/22613

PCT Pub. Date: Oct. 13, 1994

Related U.S. Application Data

(63) Continuation of application No. 08/343,597, filed on Nov. 30, 1994, now abandoned.

(30) Foreign Application Priority Data

Mar. 31, 1993 (CH) ..... 9301097

(51) Int. Cl.[7] ..... B21D 39/00; B23P 11/00

(52) U.S. Cl. ..... 29/522.1; 29/509; 29/521; 29/243.5; 29/283.5

(58) Field of Search ..... 29/505, 243.5, 29/283.5, 521, 522.1

(56) References Cited

U.S. PATENT DOCUMENTS

| | | | | |
|---|---|---|---|---|
| 4,531,279 | * | 7/1985 | Gunter | 29/509 |
| 4,584,753 | * | 4/1986 | Eckold et al. | 29/243.5 |
| 4,803,767 | * | 2/1989 | Obrecht et al. | 29/243.5 |
| 4,825,525 | * | 5/1989 | Obrecht et al. | 29/243.5 |
| 5,051,020 | * | 9/1991 | Schleicher | 29/521 X |
| 5,150,513 | * | 9/1992 | Sawdon | 29/798 |
| 5,208,973 | * | 5/1993 | Sawdon | 29/798 |
| 5,208,974 | * | 5/1993 | Sawdon et al. | 29/798 |
| 5,267,383 | * | 12/1993 | Sawdon | 29/243.5 |
| 5,315,743 | * | 5/1994 | Schleicher | 29/243.5 |
| 5,490,310 | * | 2/1996 | Schleicher | 29/243.5 |
| 5,528,815 | * | 6/1996 | Webb | 29/509 |
| 5,621,961 | * | 4/1997 | Schleicher | 29/509 |
| 5,709,019 | * | 1/1998 | Sawdon | 29/243.5 |
| 5,727,302 | * | 3/1998 | Sawdon | 29/436 |
| 5,946,782 | * | 9/1999 | Dubugnon et al. | 29/21.1 |
| 5,984,563 | * | 11/1999 | Wu | 403/282 |

* cited by examiner

*Primary Examiner*—S. Thomas Hughes
*Assistant Examiner*—Essama Omgba
(74) *Attorney, Agent, or Firm*—Young & Thompson

(57) ABSTRACT

Two or several overlaying sheet formed members are joined together using an essentially coaxial arrangement of a punch, a die with a die cavity, and an anvil. A method for joining the sheet formed members comprises the steps of placing two or several overlaying sheet formed members between the punch and the die, causing a core portion of the punch to move in a direction toward the die cavity so as to co-act with the die cavity to form a cup-shaped or protruding portion having a side wall portion and a bottom wall portion, whereby a lateral extension provided around the rear end of the core portion deforms and axially displaces material from the area around the opening of the cup-shaped or protruding portion, mainly in the upper sheet formed member, moving the anvil in a second direction and locking it in a predetermined position relative to the die, a second relative movement of the punch in the direction towards the die compresses the bottom wall portion whereby a laterally enlarged shape is formed, mechanically interlocking the sheet formed members.

4 Claims, 3 Drawing Sheets

METHOD FOR JOINING TOGETHER TWO OR SEVERAL OVERLAYING SHEET FORMED MEMBERS, AND APPARATUS FOR CARRYING OUT SAID METHOD AND A JOINT RESULTING FROM SAID METHOD

This application is a continuation of U.S. application Ser. No. 08/343,597, filed Nov. 30, 1994, now abandoned.

TECHNICAL FIELD

This invention relates to a method for joining together two or several overlaying sheet formed members, an apparatus for carrying out said method and a joint resulting from said method. Such joining procedures could e.g. be carried out by first drawing and then laterally extruding the material of the two sheet formed members to be joined into an enlarged shape which will interlock the members. A joint produced by means of this method will typically be of the leakproof type. The members could also be joined by lancing and forming a part of one member through an unblanked part of the other member and thereafter staking the lanced and formed part of the one member to an adjacent surface of the other member to secure the members together in overlaying relation. A joint produced by means of this method will typically be of the non-leakproof type.

BACKGROUND ART

Methods and apparatuses for joining sheet formed members together, thereby producing leakproof or non-leakproof joints, are previously known. Of particular interest in some applications is a type of leakproof joint which is made by means of drawing said sheet formed members into a cup-shaped or protruding portion having a cylindrical or slightly conical side wall and a bottom wall and subsequently compressing said bottom wall creating a lateral extrusion of the same thereby forming a laterally enlarged shape which mechanically interlocks the sheet formed members. The present invention, however, is also concerning other types of joints.

U.S. Pat. No. 4,459,735 discloses an apparatus, a method and a joint of this type. The method is of the single stroke type which means that the whole procedure takes place during one single relative movement between a punch and a coacting die. For the compression of the bottom wall of the cup-shaped portion an anvil is arranged fixed at the bottom of the die cavity which cavity is laterally expandable.

Double-stroke methods are also known from e.g. WO 89/07020 according to which the compression takes place during a second stroke outside the die cavity. This cavity is generally laterally non-expandable.

One problem with the leakproof joints of the above type is the relatively low resistance against so called shear and peeling forces.

It turns out that the drawing depth into the die cavity and the gap between the punch and the die cavity are critical parameters.

If the drawing depth is too big and/or the gap between the punch and the die cavity is too small the side wall of the cup-formed or protruding portion, especially on the sheet formed member touching the punch, will be too thin and there is a risk that this side wall will break when exposed to forces tending to separate the members. The problem is emphasized when the joint is made between more than two sheets.

On the other hand, if the drawing depth is too small and/or the gap between the punch and the die cavity is too big, the lateral extrusion of the bottom wall during the compression will not be sufficient to create the interlocking between the sheet formed members and there is a risk that the members separate for that reason, when exposed to forces.

DISCLOSURE OF THE INVENTION

One object of the present invention is to provide a method for joining sheet metal and/or other sheet material producing a joint of the leakproof or non-leakproof type having considerably improved strength in relation to known joints.

The claimed apparatus utilizes a new punch construction which considerably will contribute to the strength of the joint.

Another object of the invention is to provide an apparatus which is less sensitive to variations in the total thickness of the sheet members.

An advantage of the invention is the simplicity of the solution.

The present invention, which provides a solution to the said technical problems, is characterised according to the appended claims.

BRIEF DESCRIPTION OF THE FIGURES

Other objects and advantages of this invention will be apparent from the reading of this description which proceeds with reference to the accompanying drawing forming part thereof and wherein.

DETAILED DESCRIPTION OF THE INVENTION

The invention will be described by means of an embodiment in the form of a double-stroke method for creating a leakproof joint. A stroke is defined as the relative approaching between the punch and the die. To simplify the description of the example the joint is carried out on two superimposed metal sheets. The lateral expansion of the joint will take place outside the die. It is, however, once again emphasized that the invention is also applicable on single-stroke procedures with laterally flexible or fixed dies and on more than two sheet formed members and for creating non-leakproof joints.

Figure 1:
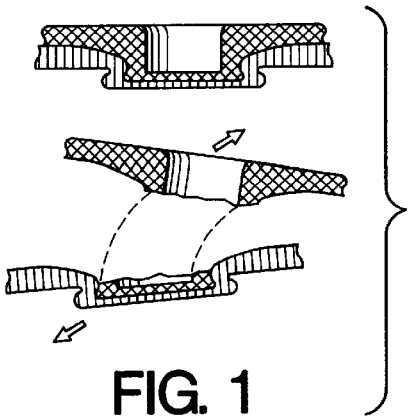
FIG. 1 PRIOR ART
FIG. 1 shows a section through a known joint with too small gap between the punch and the die cavity.

FIG. 1 shows a section through a joint produced by means of a known method with too small gap between the punch and the die cavity. The lateral expansion of the bottom wall of the cup-formed or protruding portion is satisfactory. This means that the member forming the inner wall of the cup-formed or protruding portion has a good grip inside the mushroom formed cavity in the other member. On the other hand, however, the inner side wall of the cup-formed portion is, due to the drawing of the material, very thin and this part will constitute the weak zone of the joint.

Figure 2:
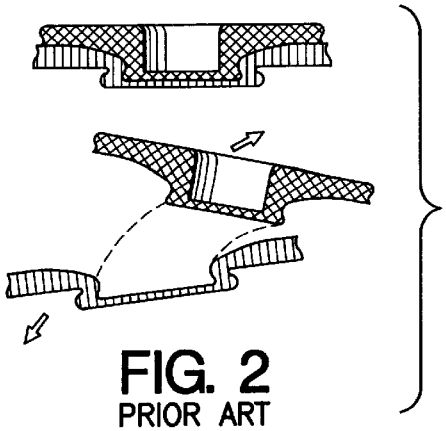
FIG. 2 PRIOR ART
FIG. 2 shows a section through a known joint with too big gap between the punch and the die cavity.

In FIG. 2 is shown a section through a known joint with too big gap between the punch and the die cavity. The lateral expansion of the bottom wall of the cup-formed portion is not satisfactory in this case. The member forming the inner wall of the cup-formed portion does not grip sufficiently inside the mushroom formed cavity in the other member. When exposed to forces the members will separate as indicated. The same effect will be created if the drawing depth would be too small.

The drawing depth and/or the gap between the punch and the die cavity are thus critical to the strength of the joint and have to be carefully chosen with regard to total thickness of the members, material etc. It is evident that a change of for instance the total thickness, number of sheets etc., if not compensated for, will be detrimental to the quality of the joint.

Figure 3A:
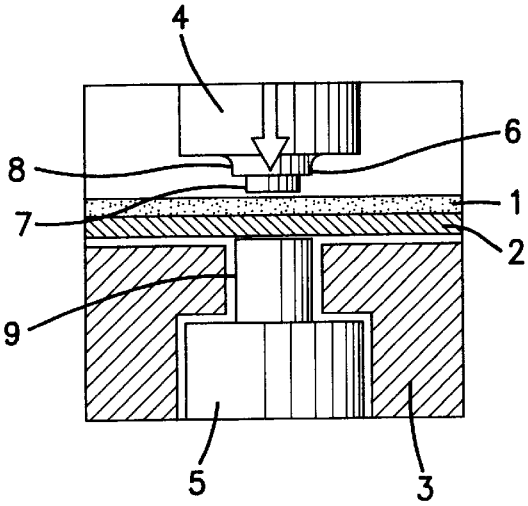
FIGS. 3*a–d* show, partly in section, the relative movements of a punch, a die and an anvil during a joint forming operation in an apparatus according to this invention.
Figure 3C:
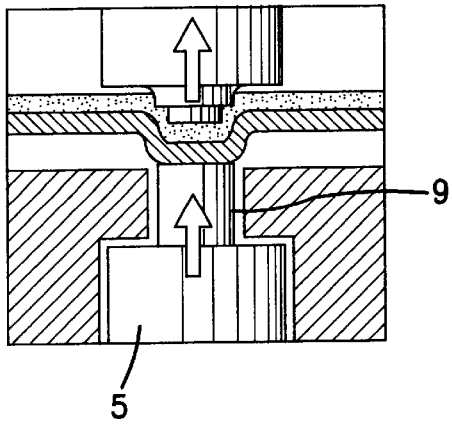

FIGS. 3*a–d* show, partly in section, the relative movements of a punch, a die and an anvil during a joint forming operation in an apparatus according to the invention. As shown in FIG. 3*a*, the two metal sheets 1, 2 to be joined are positioned on top of the die 3. A punch 4 is arranged coaxially with the die to cooperate with the same in a relative movement. This is to say that in a machine-fixed coordinate system the die 3 or the punch 4 or both can be moving. For the joining process the relative movement between the punch and the die is the essential. Inside the die an anvil 5 is arranged to move coaxially with the die 3 and the punch 4. The relative movement between the anvil and the die is the essential.

The tip 7 of the core portion 6 of the punch has an essentially cylindrical or sometimes a slightly conical form and can have a circular section perpendicular to the axis or an oval section or any other suitable section. The die cavity 9 will have a suitable cooperating section in each case chosen depending on the material thickness, the kind of joint to be produced etc.

Figure 3B:
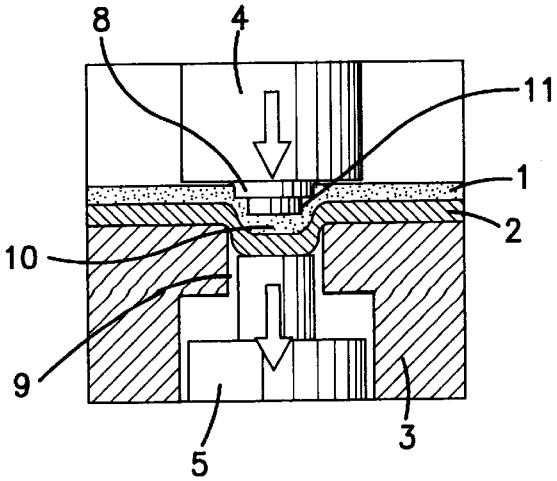

In FIG. 3*b* the punch has been activated by means of any suitable drive system, mechanical, pneumatic, hydraulic, electrical etc. and the punch has due to the applied forces drawn the material of the two sheet formed members 1, 2 down and into the die cavity 9, thereby creating on the surfaces of the two members a cup-formed or protruding portion 10. During this step the anvil 5 which could be spring loaded is moved downwards against the spring force.

The essentially cylindrical core portion of the punch 6 has been provided with an external extension 8 around its rear end. This extension 8 will, by means of the applied forces, deform and displace material from the area around the opening 11 of the created cup-formed portion 10 in the direction of the die 3, thus modifying the weak zone in the sidewall of the joint with the view of an overall reinforcement of said wall, as defined above. This deformation and displacement of material will act on both members 1, 2 but to the greatest extent on the upper member 1 which is directly acted upon by the punch.

In the next step of the exemplified double-stroke method the anvil 5 is activated by means of a suitable power system to exit the cup-formed portion 10 from the die cavity 9. During this phase the punch is released and follows the movement of the members upwards. The anvil 5 is then locked in a pre-defined position in which its tip could be flush with the top surface of the die, somewhat protruding over this surface or being positioned somewhat below said surface. It should here be noted that the tip of the anvil and/or the punch is/are not necessarily flat, but can have ridges or grooves arranged e.g. for increasing the extrusion of the material.

Figure 3D:
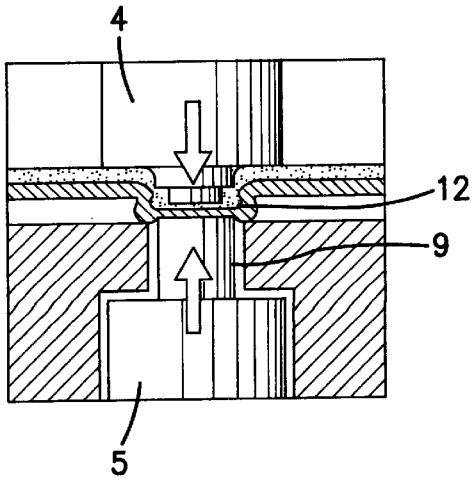

In the final step, according to FIG. 3*d*, the second stroke is applied by means of the punch 4 towards the locked anvil 5. The drawing process is now being finalized and the bottom wall 12 of the cup-formed portion 10 is compressed which causes a lateral extrusion of material of both the sheet formed members. A laterally enlarged shape is created which mechanically interlocks the members 1, 2.

Thus, the application of an lateral extension 8 around the rear end of the core portion 6 of the punch 4 makes it possible to considerably increase the strength of the joint. The cross section and dimensions of the extension can be chosen to suit the actual forces applied, the material used, the thickness of the individual sheets, the total thickness, the friction, the hardness and strength properties of the different materials etc. As illustrated in FIGS. 3A–3D of the drawing, the lateral extension (8) around the portion (6) of the punch (4) has an external diameter which is not greater than the diameter of the initial opening in the die cavity (9).

Figure 4:
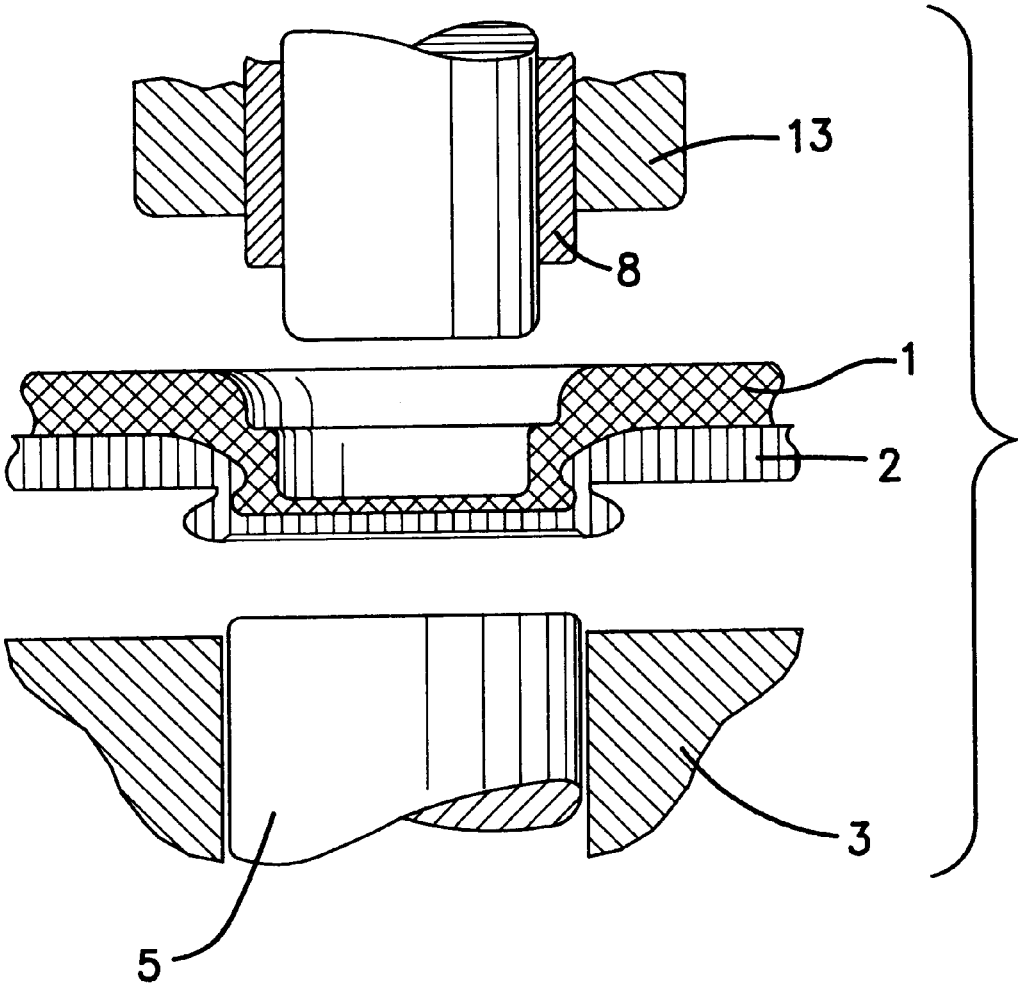
FIG. 4 shows a punch according to the invention with movable sidepressing and lateral extension elements.
Figure 5A:
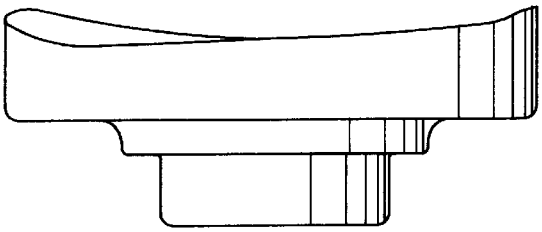
FIG. 5 shows a few examples of different punch designs according to the invention.
Figure 5D:
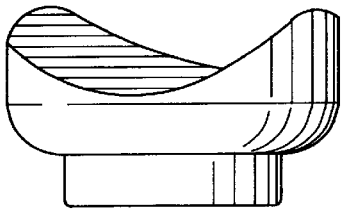
Figure 5B:
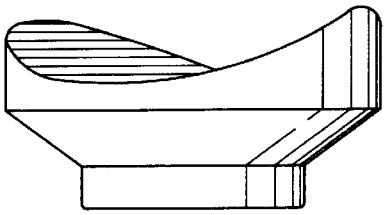
Figure 5E:
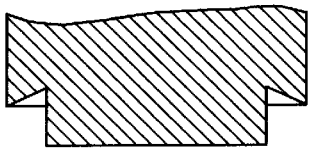
Figure 5C:
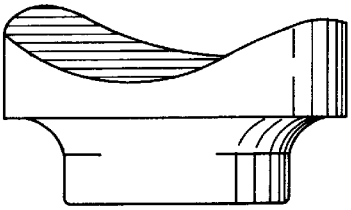
Figure 5F:
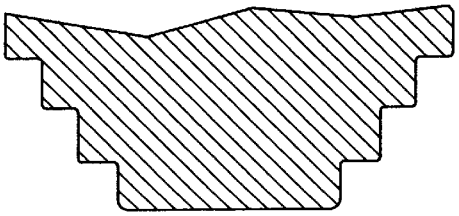

FIG. 4 shows another punch according to the invention provided with a lateral extension 8 in the form of a coaxial sleeve movable in relation to the core 6 of the punch 4 and a sidepressing device 13. The extension 8 could be arranged adjustable on the core to be preset on the same before the start of the process. During the process the extension 8 will then follow the movement of the core 6. In an alternate embodiment the sleeve could be spring mounted following the movement of the core 6 in the first part of the punching process only. In a further embodiment the sleeve could be freely movable and separately actuated e.g. by means of a pneumatic or hydraulic system. In said last mentioned embodiment the sleeve could be operated prior to, simultaneously with or after the actuation of the punch core in order to achieve different desired effects on the deformation and displacement of the material of the sheet formed members. It is further noted that the external extension 8 can have a non-uniform action around the circumference of the punch-core.

In order to avoid a local deformation during the process of the members 1, 2, outside and around the joint, a sidepressing device 13 can be arranged around the punch 4. If the punch is provided with a sleeve 8, as in FIG. 4, the sidepressing device will be arranged on the outside of the sleeve. Such an arrangement could e.g. be implemented by means of a ring of elastic material around the punch-core or the sleeve. Another example could be a spring mounted ring or a ring actuated by means of an active pneumatic or hydraulic control mechanism, not shown. In the example according to FIG. 3 the sidepressing device forms an integral part of the punch.

In FIG. 5*a–f* a few different examples of the punch design according to the invention are shown. The lateral extension 8 of the punch-core 6 can have different cross sections. In all cases it contributes, however, to the deformation and displacement of the material from the area around the opening 11 of the created cup-formed or protruding portion 10 in the direction of the die 3. In this figure the lateral extension has been shown as an integral part of the punch. It is, however, understood that in each case the extension can be implemented in the form of a sleeve around the punch-core.

Figure 6:
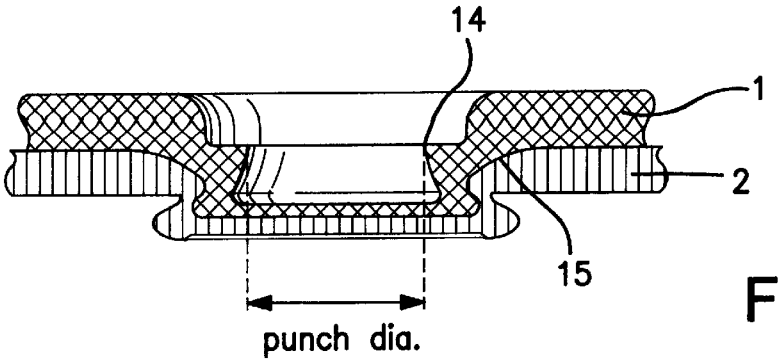
FIG. 6 shows an embodiment of the joint according to the invention.

FIG. 6 shows an embodiment of the joint according to the invention. The deformation and displacement of the material in the direction of the die has further laterally extruded the material around the tip 7 of the punch-core 6 so that the inner sidewall of the joint only touches the punch in the annular zone designated 14. This means that the forces needed to extract the punch from the joint will be much smaller due to the lower friction between the wall and the punch. Additionally the grip between the sheet formed members is increased due to the increased lateral extrusion. In traditional joints of this type an undesired annular pocket 15 is formed between the sheets around the joint. It has been shown that this pocket can be eliminated or almost eliminated by the method according to the invention.

Measurements have shown that an increase of the mechanical resistance of the joint of 20% and more can easily be achieved by the method according to the invention.

It is understood that one set of punch, die and anvil will allow a certain range of total thickness or number of sheet layers of the processed sheet formed members, still giving a higher strength of the joint than what is achieved by means of other methods.

What is claimed is:

1. A method for joining together a plurality of sheets, comprising the steps of:

providing a punch having a generally cylindrical core portion terminating in a tip at a first end of the core portion, said core portion being surrounded by a circumferential lateral extension extending outward from a second end of the core portion, said lateral extension having an outer diameter;

providing a die having a horizontally extending surface defining a cavity that has a diameter no smaller than the outer diameter of the lateral extension, and an anvil having a top surface that is adapted to move within said cavity;

providing an upper sheet and a lower sheet;

positioning said punch relative to said die, such that said core portion and said cavity are co-axial;

positioning said sheets between the punch and the die;

first moving said punch axially toward said die in a first direction, thereby causing said tip to force material of said sheets into said cavity, whereby said material of said sheets is deformed into a cup-shaped portion having a side wall portion and a bottom wall portion;

moving said anvil towards the plane defining the horizontally extending surface of said die and locking said anvil in a predetermined position relative to the die; then moving said punch toward said die in said locked position, thereby compressing said material of said sheets between said tip and said anvil such that said bottom wall portion of said cup-shaped portion bulges outwardly;

wherein during the first moving step, the circumferential lateral extension displaces material of the upper sheet axially in the first direction.

2. The method of claim 1, wherein an extent of the movement of the punch toward the die is limited so that any portion of the punch radially outside the cavity of the die comes no closer to the horizontally extending surface of the die than a distance equal to a combined thickness of the sheets.

3. A method for joining together a plurality of sheets, comprising the steps of:

providing a punch having a generally cylindrical core portion terminating in a tip at a first end of the core portion, said core portion being surrounded by a circumferential lateral extension extending outward from a second end of the core portion, said lateral extension having an outer diameter;

providing a die having a horizontally extending surface defining a cavity that has a diameter no smaller than the outer diameter of the lateral extension, and an anvil having a top surface;

providing an upper sheet and a lower sheet;

positioning said punch relative to said die, such that said core portion and said cavity are co-axial;

positioning said sheets between the punch and the die;

moving said punch axially toward said die in a first direction, thereby causing said tip to force material of said sheets into said cavity, whereby said material of said sheets is deformed into a cup-shaped portion having a side wall portion and a bottom wall portion; and exerting a force between the punch and the anvil to compress said material of said sheets between said tip and said anvil such that said bottom wall portion of said cup-shaped portion bulges outwardly;

wherein during the first moving step, the circumferential lateral extension displaces material of the upper sheet axially in the first direction.

4. The method of claim 3, wherein an extent of the movement of the punch toward the die is limited so that any portion of the punch radially outside the cavity of the die comes no closer to the horizontally extending surface of the die than a distance equal to a combined thickness of the sheets.

* * * * *